United States Patent [19]

McGlashan et al.

[11] 4,451,807

[45] May 29, 1984

[54] TELEVISION RASTER PINCUSHION DISTORTION CORRECTION DEVICE

[75] Inventors: Kenneth W. McGlashan, Indianapolis; John R. Archer, Carmel, both of Ind.

[73] Assignee: RCA Corporation, New York, N.Y.

[21] Appl. No.: 517,832

[22] Filed: Jul. 27, 1983

[51] Int. Cl.[3] ..... H01F 3/12

[52] U.S. Cl. ..... 335/211; 335/210

[58] Field of Search ..... 335/210, 211, 212, 213, 335/214; 313/421, 431

[56] References Cited

U.S. PATENT DOCUMENTS

| | | | |
|---|---|---|---|
| 4,237,437 | 12/1980 | Vink et al. | 335/211 |
| 4,257,023 | 3/1981 | Kamijo | 325/211 |
| 4,307,363 | 12/1981 | McGlashan | 325/211 |
| 4,357,586 | 11/1982 | Barkow et al. | 335/211 |

*Primary Examiner*—George Harris

*Attorney, Agent, or Firm*—Paul J. Rasmussen; Joseph Laks; Scott J. Stevens

[57] ABSTRACT

A television receiver deflection yoke mounted on a kinescope incorporates toroidally wound vertical deflection coils which generate stray fields that undesirably interact with components of adjacent receivers or video monitors. The deflection yoke incorporates magnetically permeable field forming members which utilize the stray field flux to form an electromagnetic field at the front of the yoke to aid in side pincushion distortion correction. The field forming members comprise a flux gathering portion which is located within the region of the stray field and follows the contour of the yoke core. The flux gathering portions extend along substantially the entire length of the vertical coils and are curved to encompass a significant portion of the external surface of the core in order to reduce the undesirable effects of the stray field and to form a strong pincushion distortion correcting field.

10 Claims, 5 Drawing Figures

TELEVISION RASTER PINCUSHION DISTORTION CORRECTION DEVICE

This invention relates to raster distortion correction for television receivers and, in particular, to structures which provide side pincushion distortion correction by modifying stray fields of the deflection yoke.

The picture tube or kinescope of a color television receiver produces three electron beams which are caused to strike particular phosphor spots or stripes on a display screen of the kinescope. The phosphor elements, when energized by the electron beams, emit light of a particular color. The kinescope is designed so that each electron beam strikes only one particular color-producing phosphor type.

It is important that the three electron beams strike their respective color-producing phosphor elements in close proximity to each other (i.e., the beams should converge) at all locations on the display screen in order to produce the proper color blending to generate an acceptable color picture. With an inline kinescope it is possible to design a deflection yoke which substantially converges the three electron beams at all locations on the kinescope display screen without the need for dynamic convergence circuits. This is accomplished by winding the yoke deflection coils with particular winding distributions in order to produce nonuniform deflection fields which act unequally on the spatially separated beams. The result of the nonuniform field's action on the beams is the desired beam convergence at the kinescope display screen. In particular, the horizontal deflection coils, commonly of saddle-type design, are wound to produce a deflection field whose flux lines form a pincushion shape, as viewed along the longitudinal axis of the deflection yoke. The vertical deflection coils, commonly being toroidally wound on a magnetically permeable core, are designed to produce a barrel-shaped field.

It is known that certain types of raster distortion may be corrected by changing the deflection field nonuniformity in localized regions along the yoke longitudinal axis. For example, pincushion raster distortion, caused by differences between the beam deflection radius and the geometry of the kinescope faceplate, may be corrected by forming a pincushion shaped field near the beam exit end of the deflection yoke. Top and bottom pincushion distortion is corrected by modifying the horizontal deflection field while side pincushion distortion is sensitive to modifications in the vertical deflection field. Changing the vertical coil winding distribution to produce the desired pincushion shaped field at the beam exit end of the yoke is difficult, since the coil must produce an effective net barrel shaped field to provide beam convergence. The abrupt localized changes in nonuniformity place severe constraints on the position of the coil wire turns, making the yoke difficult and expensive to produce.

U.S. Pat. No. 4,257,023 illustrates a device which modifies the stray field produced by a toroidally wound vertical deflection coil in order to generate a pincushion shaped field at the beam exit end of the yoke. The amount of pincushion distortion correction provided by this arrangement may be insufficient to correct the distortion that is present, particularly when used with kinescopes having large deflection angles (e.g., 110°).

The previously described toroidally wound vertical deflection coils produce extensive external or stray fields which, as described, may be utilized to aid in raster distortion correction. The stray fields, however, may undesirably interact with other television monitors or receivers located nearby causing, for example, a deterioration of color purity.

It would be desirable to provide a pincushion distortion correction structure which would be effective for kinescopes having large deflection angles yet would reduce the undesirable interaction of the deflection yoke stray fields with adjacent receivers.

In accordance with the present invention, a deflection yoke comprises a magnetically permeable core and a pair of deflection coils toroidally wound on the core. The coils are adapted to be coupled to a source of deflection signals to produce a deflection field encircled by the core and a stray field external to the core. Field shaping apparatus comprises magnetically permeable flux directing structure located at the front of the yoke for influencing the movement of an electron beam. Magnetically permeable flux gathering structure is located within the stray field and is coupled to the flux directing structure. The flux gathering structure extends along substantially the entire length of said deflection coils.

In the accompanying drawing.

Figure 1:
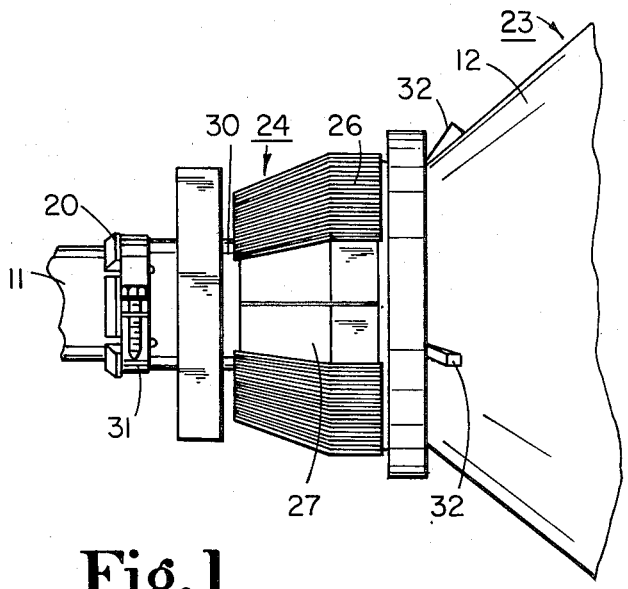
FIG. 1 is a side elevational view of a portion of a television display system illustrating elements of its construction.

Referring to FIG. 1, there is shown a portion of a television display system incorporating a kinescope 23 having a neck region 11 and a funnel region 12. An electron gun assembly (not shown) is located within the neck region 11 of the kinescope and produces three horizontally aligned electron beams which are caused to strike a phosphor display screen on the front panel of the kinescope (also not shown) which is located at the end of the funnel region remote from the neck 11.

Mounted to kinescope 23 in the vicinity of the transition between the neck 11 and funnel 12 is a deflection yoke 24. Yoke 24 comprises a pair of saddle-type horizontal deflection coils 25 (shown in FIG. 4) which are located adjacent to and generally follow the surface contour of kinescope 23. A pair of vertical deflection coils 26 are toroidally wound on a magnetically permeable core 27, which encircles kinescope 23. A plastic insulator 30 electrically and physically separates the horizontal and vertical deflection coils from each other and may incorporate structure not generally illustrated which aids in support and alignment of the coils and the core 27. Insulator 30 also incorporates flexible finger-like members 20 at the rear of yoke 24 which cooperate with a clamp 31 to hold yoke 24 in place on the neck 11 of the kinescope. The yoke 24 may be adjusted by tilting or pivoting the yoke about its clamped position and then fixing its position via some conventional means, such as wedges 32 inserted between yoke 24 and funnel 12 at the front of the yoke. Deflection yoke 24 is adapted to be energized by a source of horizontal and vertical deflection signals (not shown) which cause the yoke to produce the appropriate deflection fields.

As previously described, yoke 24 comprises saddle-type horizontal deflection coils and toroidal wound vertical deflection coils, which is commonly referred to as a saddle-toroid, or "S/T" yoke. The toroidal wound vertical coils generate extensive stray or external fields. These stray fields may interact with video circuits in other receivers or video monitors located nearby producing visual distortion. Stray field interaction with adjacent sets' shadow masks may degrade color purity. This is a particularly serious problem in commercial or professional computer installations, where several monitors or video display terminals may be positioned close together. As described previously, and as described in U.S. Pat. No. 4,257,023, a portion of this stray field my be reshaped to aid in raster distortion correction (e.g., side pincushion distortion correction). However, the structure shown and described in U.S. Pat. No. 4,257,023 leaves a large area of the vertical coil assembly uncovered and therefore does little to reduce the effects of undesirable interaction of the stray field with adjacent receivers or monitors. The structure shown and described also may not provide sufficient side pincushion distortion correction, particularly with kinescopes having large deflection angles (e.g., 110°) where raster distortion is severe.

Figure 2:
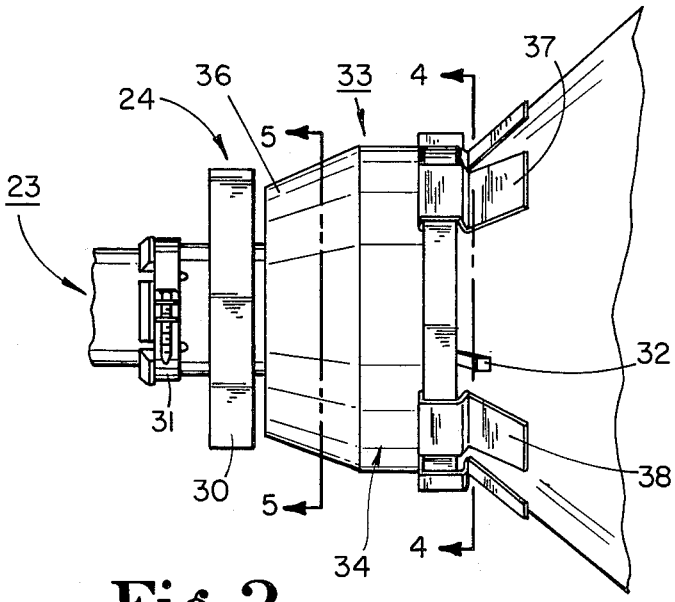
FIG. 2 is a side elevational view of the television display system shown in FIG. 2, illustrating raster distortion correction structure in accordance with the present invention.
Figure 3:
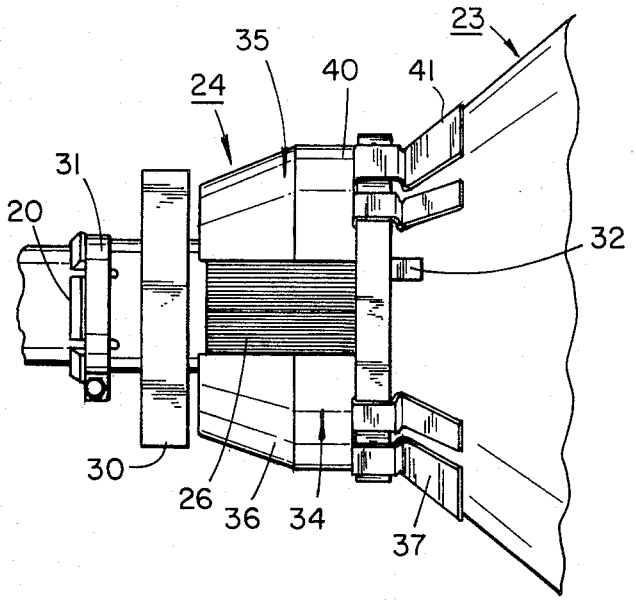
FIG. 3 is a top plan view of the television display system shown in FIG. 2.
Figure 4:
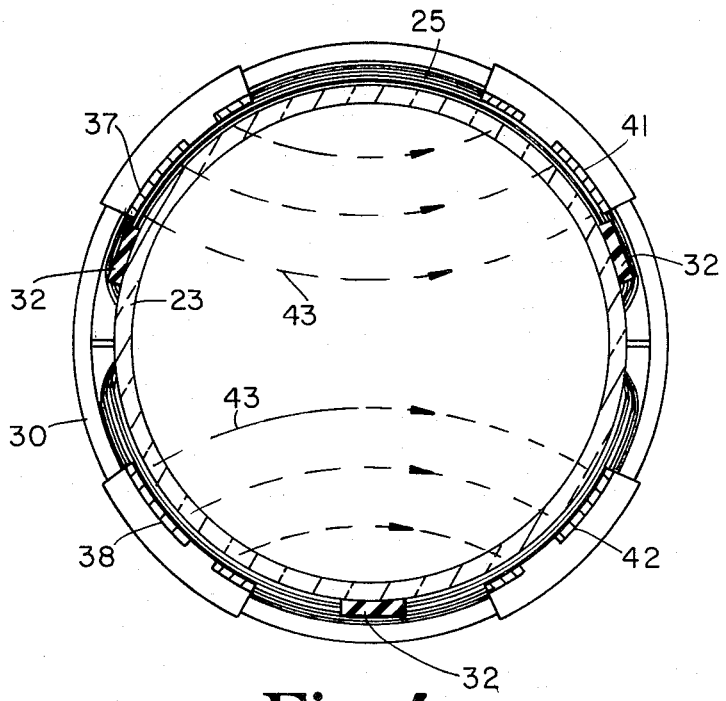
FIG. 4 is a front cross-sectional view of the television display system shown in fIG. 2, taken along line 4—4.
Figure 5:
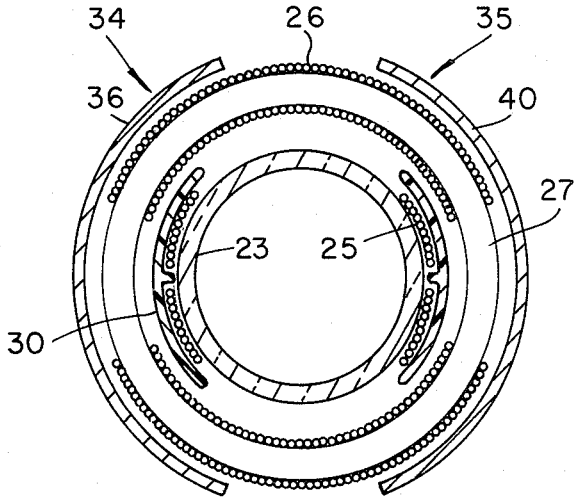
FIG. 5 is a front cross-sectional view of the television display system shown in FIG. 2, taken along line 5—5.

In accordance with an aspect of the present invention, FIG. 2 shows the television display system of FIG. 1 incorporating field shaping apparatus 33 which is located within the stray or external field produced by vertical deflection coils 26. Field shaping apparatus 33 provides a low reluctance path for flux of the stray field which is redirected or reshaped in a desirable manner to aid in providing side pincushion distortion correction. As can be seen in FIGS. 2, 3, and 4, field shaping apparatus 33 comprises field forming members 34 and 35 located on opposite sides of deflection yoke 24. Field forming members 34 and 35 are made of a material having a high magnetic permeability, such as silicon steel. Field forming member 34 comprises a flux gathering portion 36 and flux directing portions 37 and 38 located above and below the yoke horizontal axis plane, respectively. Field forming member 35 comprises a flux gathering portion 40 and flux directing portions 41 and 42, located above and below the yoke horizontal axis, respectively. Flux gathering portions 36 and 40 are located along the outer surface of the vertical deflection coils 26 and core 27. As can be seen in FIGS. 2 and 3, flux gathering portions 36 and 40 closely follow the bell-shaped contour of core 27 and extend substantially the entire length of core 27 in order to reduce the reluctance of the flux return path from the flux directing portions 37, 38, 41 and 42 back to the core 27. The flux gathering portions 36 and 40 also curve to follow the circumference of core 27 as seen in FIG. 5 so that the flux gathering portions 36 and 40 encompass a significant portion i.e., more than half, of the external surface of core 27. The gap between flux gathering portions 36 and 40, as can be seen in FIGS. 3 and 5, increases the reluctance between flux gathering portions 36 and 40 so that most of the flux in field forming members 34 and 35 is directed to flux directing portions 37, 38, 41 and 42. The large area of the core surface covered by flux gathering portions 36 and 40 results in close communication between the core 27 and flux gathering portions 36 and 40 so that a significant amount of the flux of the stray field produced by vertical deflection coils 26 flows in flux gathering portions 36 and 40 and is therefore shunted away from field sensitive areas of adjacent receivers and monitors. As a result, the interaction between the stray field and other receiver or monitor components or circuits is greatly reduced.

Stray field flux collected by flux gathering portions 36 and 40 flows into flux directing portions 37, 38, 41 and 42. An electromagnetic field is formed between flux directing portions 37 and 41, and between flux directing portions 38 and 42, as shown by field lines 43 in FIG. 4. The shape and location of the flux directing portions causes this field to be pincushion shaped, which, as previously described, aids in side pincushion distortion correction.

As previously stated, a significant amount of the stray field flux is collected by flux gathering portions 36 and 40. This provides sufficient flux necessary to form a field of suitable intensity in order to correct side pincushion distortion in kinescopes having large (e.g., 110°) deflection angles. The large amount of flux also gives added flexibility in the location of flux directing portions 37, 38, 41 and 42 such that a desirable balance can be made between side pincushion distortion correction and north-south raster geometry distortion, which is introduced or aggravated by the presence of the field shaping apparatus 36.

The large area occupied by flux gathering portions 36 and 40 of field forming members 34 and 35 acts to both reduce interaction between the yoke stray fields and receiver or monitor components and because of the large amount of stray field flux collected, may provide sufficient side pincushion distortion correction for large deflection angle kinescopes without the need for additional correction arrangements, such as biased deflection windings and dynamic correction circuits.

Field forming members 34 and 35 may be attached to insulator 30 or some other element of yoke 24, for example, via some conventional arrangement, not shown, such as adhesive, tape, or by pins or tabs formed in insulator 30 which cooperate with holes or slots formed in field forming members 34 and 35.

What is claimed is:

1. A deflection yoke comprising:

a magnetically permeable core;

a pair of deflection coils toroidally wound on said core and adapted for coupling to a source of deflection signals for producing a deflection field encircled by said core and producing a stray field external to said core; and field shaping apparatus comprising:

magnetically permeable flux directing means disposed at the front of said yoke for forming an electromagnetic field at the front of said yoke for influencing the movement of an electron beam;

magnetically permeable flux gathering means located within said stray field and coupled to said flux directing means, said flux gathering means extending along substantially the entire length of said deflection coils and encircling a significant portion of said coils.

2. The arrangement defined in claim 1, wherein said deflection coils provide vertical deflection of said electron beam.

3. The arrangement defined in claim 2, wherein said electromagnetic field is pincushion shaped.

4. The arrangement defined in claim 3, wherein said electromagnetic field corrects side pincushion distortion of a raster scanned by said electron beam.

5. The arrangement defined in claim 1, wherein said flux directing means comprises individual flux directing members on opposite sides of said yoke, said electromagnetic field being formed between respective ones of said flux directing members on opposite sides of said yoke.

6. The arrangement defined in claim 1, wherein said flux gathering means is located in close proximity to said core.

7. The arrangement defined in claim 6, wherein said magnetically permeable core has generally a bell-shaped contour and said flux gathering means follows said bell-shaped contour of said core.

8. The arrangement defined in claim 7, wherein said flux gathering means shunts a significant portion of the flux of said stray field.

9. A deflection yoke comprising:

a magnetically permeable core;

a pair of deflection coils toroidally wound on said core and adapted for coupling to a source of deflection signals for producing a deflection field encircled by said core and producing a stray field external to said core; and field shaping apparatus comprising:

magnetically permeable flux directing means disposed at the front of said yoke for forming an electromagnetic field at the front of said yoke for influencing the movement of an electron beam;

magnetically permeable flux gathering means located within said stray field and coupled to said flux directing means, said flux gathering means encompassing more than half of the external surface of said core.

10. A television display system comprising:

a pair of deflection coils toroidally wound on said core and adapted for coupling to a source of deflection signals for producing a deflection field encircled by said core for deflecting said electron beam, said deflection coils also producing a stray field external to said core; and field shaping apparatus comprising:

magnetically permeable flux directing means disposed at the front of said yoke for forming an electromagnetic field at the front of said yoke for influencing the movement of said electron beam;

magnetically permeable flux gathering means located within said stray field and coupled to said flux directing means, said flux gathering means extending along substantially the entire length of said deflection coils and encircling a significant portion of said coils.

* * * * *